US006857994B2

(12) United States Patent
Yu

(10) Patent No.: US 6,857,994 B2
(45) Date of Patent: Feb. 22, 2005

(54) ADJUSTABLE HANDLES FOR SPRING BARS

(75) Inventor: Hui-Nan Yu, Taoyuan (TW)

(73) Assignee: Jao-Hsing Tsai, Hsinchu (TW)

( * ) Notice: Subject to any disclaimer, the term of this patent is extended or adjusted under 35 U.S.C. 154(b) by 35 days.

(21) Appl. No.: 10/337,345

(22) Filed: Jan. 7, 2003

(65) Prior Publication Data

US 2004/0132592 A1 Jul. 8, 2004

(51) Int. Cl.[7] ..... A63B 23/14

(52) U.S. Cl. ..... 482/126; 482/121; 482/46; 482/44

(58) Field of Search ..... 482/126, 121, 482/44, 46, 122, 124, 125, 127, 49

(56) References Cited

U.S. PATENT DOCUMENTS 3,761,083 A * 9/1973 Buchner
5,569,137 A * 10/1996 Uen ..... 482/126
5,709,630 A * 1/1998 Froelich, Sr. et al. ..... 482/46
6,390,959 B1 * 5/2002 Tornabene et al. ..... 482/26
6,648,804 B2 * 11/2003 Chen ..... 482/125

* cited by examiner

*Primary Examiner*—Jerome W. Donnelly
(74) *Attorney, Agent, or Firm*—Alan D. Kamrath; Nikolai & Mersereau, P.A.

(57) ABSTRACT

A spring bar includes a spring, and two tubes are respectively connected to two ends of the spring. Each of the tubes has a slot, and a plurality of positioning recesses are defined in two insides defining the slot. Two mounting collars are respectively mounted to the two extensions on the two handles, and a through hole is defined through each of the mounting collars. Each of the two positioning members has a spring member which is biased in the mounting collar corresponding thereto and movably extends through the positioning hole and inserted in the slot. An annular groove is defined in each of the positioning members so that the handles can be pulled outward after the positioning members are pushed.

5 Claims, 8 Drawing Sheets

ADJUSTABLE HANDLES FOR SPRING BARS

FIELD OF THE INVENTION

The present invention relates to an exercising device including a spring with two handles connected to two ends of the spring. The two handles can be moved relative to the spring so as to meet users with different sizes.

BACKGROUND OF THE INVENTION

A conventional spring bar 80 is shown in FIG. 8 and generally includes a spring 81 with two tubes 82 fixedly connected to two ends of the spring 81. Each tube 82 is connected to a handle 83 such that the user may hold the two handles 83 and try to bend the spring 81 to exercise the muscles of the chest or arms according to the distance between the two handles 83. The spring 81 is exposed without any protection so that when bending the conventional spring bar 80, the gaps between the coils of the spring 81 could hurt the user especially if the spring 81 is moved close to the body of the user when bending it. Besides, the length of the conventional spring bar 80 cannot be adjusted so that it cannot be suitable for different users.

The present invention intends to provide a spring bar that has two adjustable handles so that the distance between the two handles can be adjusted to meet the needs of different users.

SUMMARY OF THE INVENTION

In accordance with one aspect of the present invention, there is provided a spring bar which comprises a spring and two cables which are fixedly connected to an outside of the spring in a longitudinal direction of the spring. Each cable has two connection ends at two ends thereof. Two tubes are respectively connected to two ends of the spring, and a slot is defined longitudinally through a wall of each of the tubes. A plurality of positioning recesses are defined in two insides defining the slot. Two end collars are respectively mounted to the two tubes, and the two connection ends of each cable are fixedly connected to the two end collars.

Two handles each have an extension, and a positioning hole is defined through each of the extensions. Two mounting collars are respectively mounted to the two extensions and a through hole is defined through each of the mounting collars. Two positioning members each have a spring member which is biased in the mounting collar corresponding thereto and each of which movably extends through the positioning hole and is inserted in the slot. An annular groove is defined in each of the positioning members, and a width of the annular groove is larger than a thickness of the insides of the slot. The positioning members are positioned in one of the positioning recesses.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
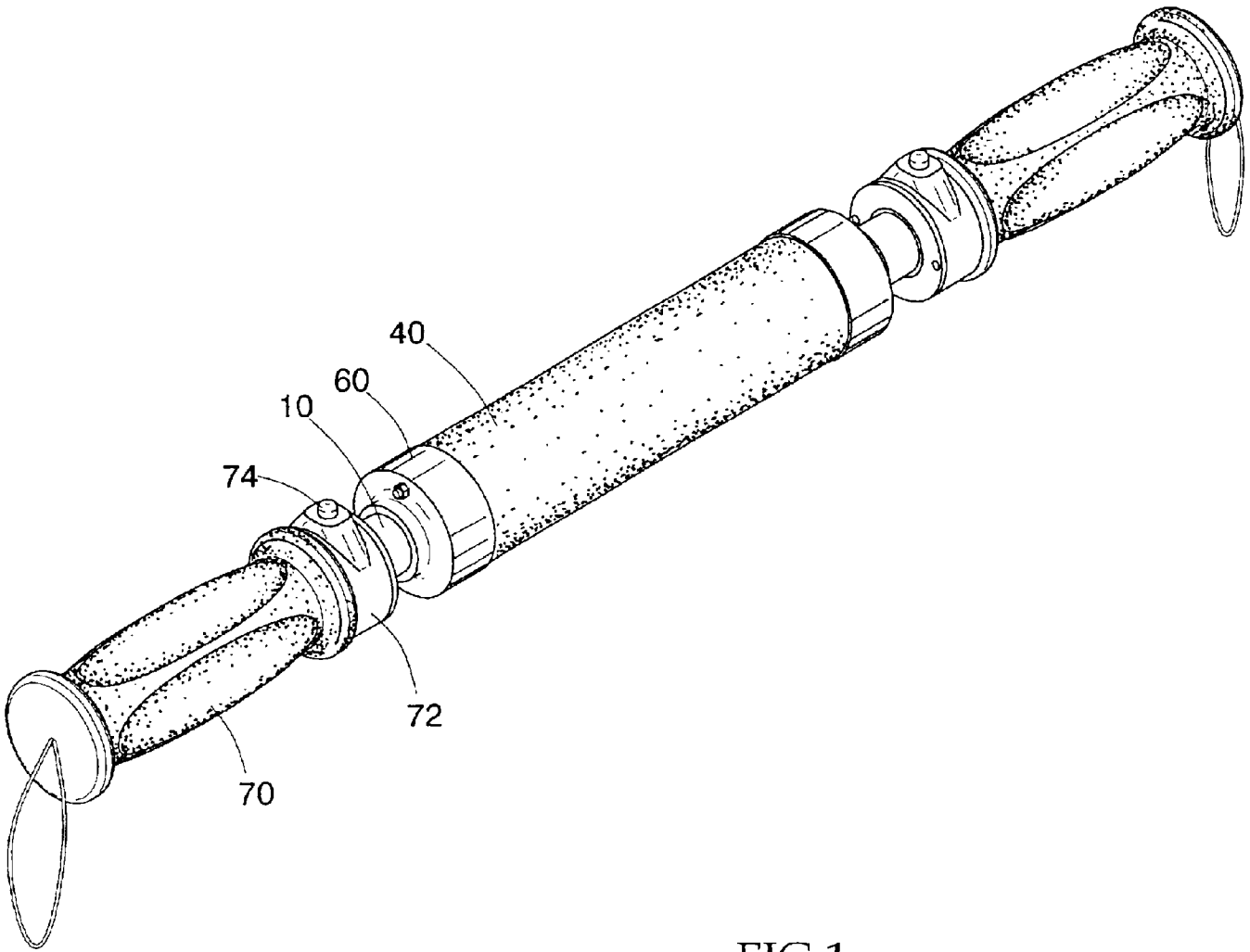
FIG. 1 is a perspective view to show the spring bar of the present invention.
Figure 2:
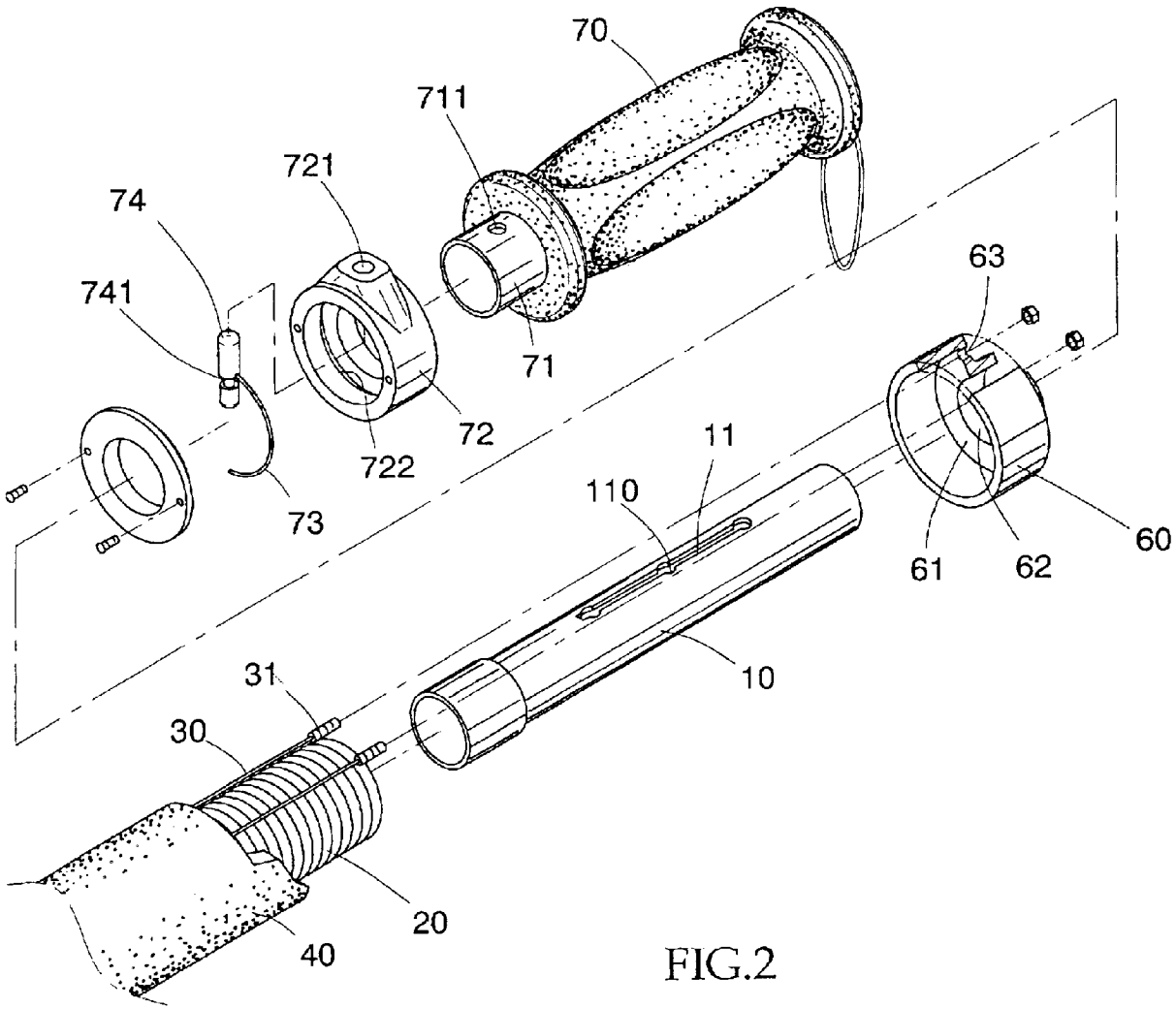
FIG. 2 is an exploded view to show the spring bar of the present invention.
Figure 3:
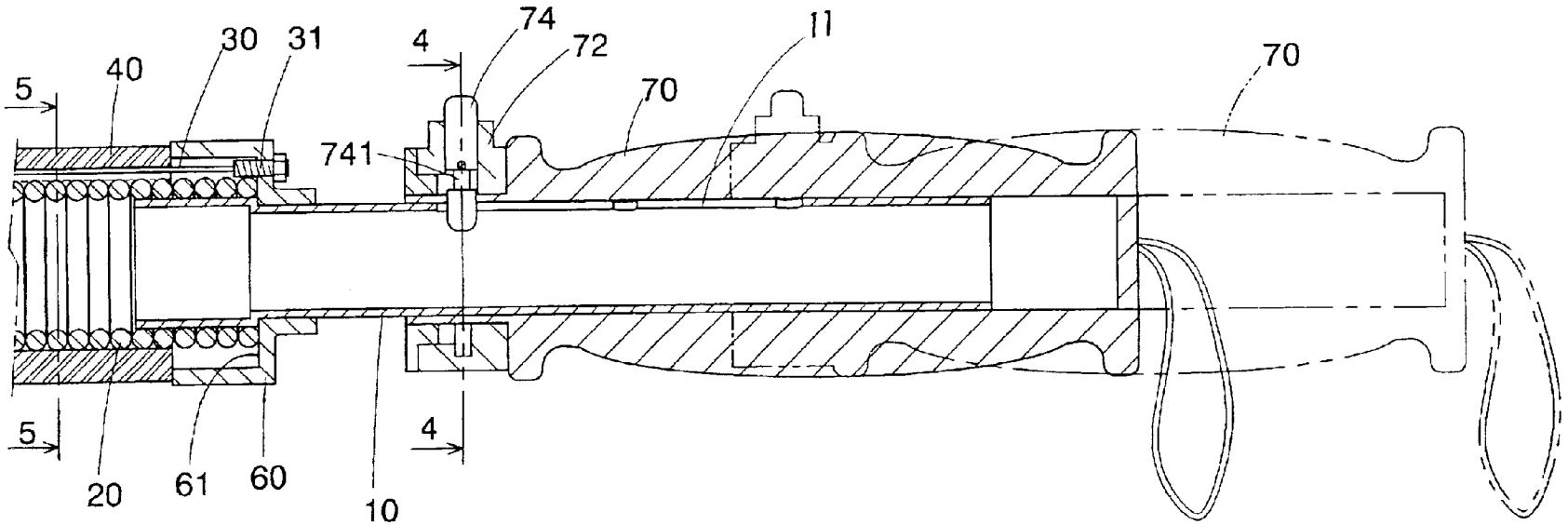
FIG. 3 is a cross sectional view to show the spring bar of the present invention.
Figure 5:
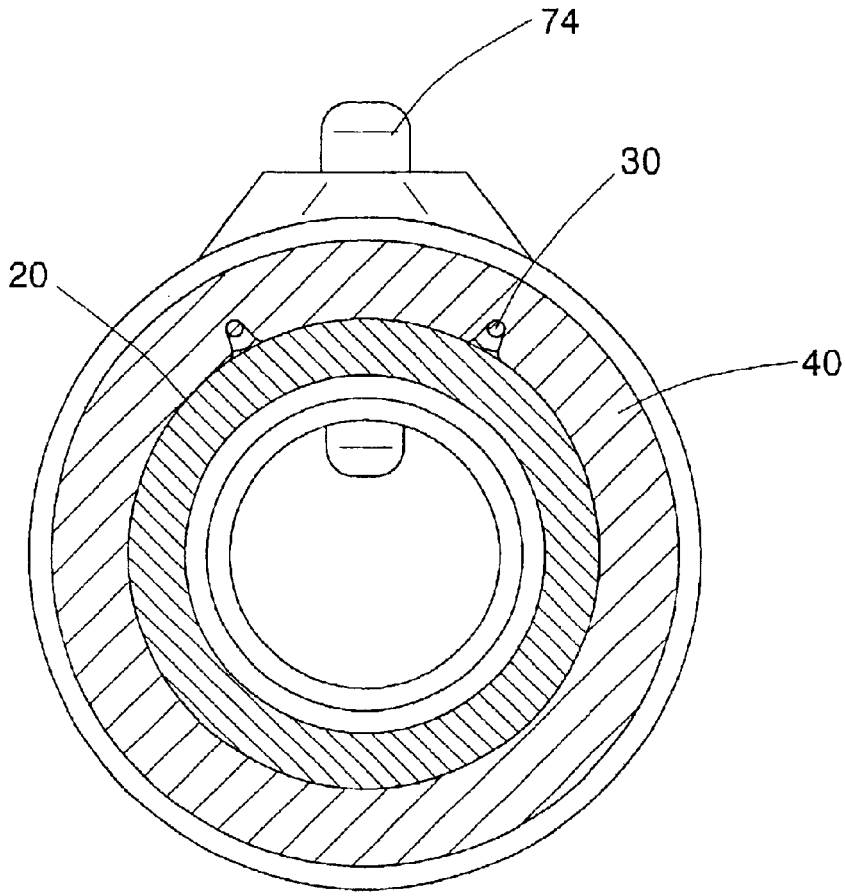
FIG. 5 is an end cross sectional view to show the cables and the spring.

Referring to FIGS. 1 to 3, the spring bar of the present invention comprises a spring 20 with a coat 40 mounted an outside of the spring 20. Two cables 30 are fixedly connected to an outside of the spring 20 in a longitudinal direction of the spring 20. Each cable 30 has two connection ends 31 at two ends thereof. An angle between the two cables 30 is 45 degrees relative to a center of the spring 20 as shown in FIG. 5.

Two tubes 10 are respectively connected to two ends of the spring 20, and a slot 11 is defined longitudinally through a wall of each of the tubes 10. A plurality of positioning recesses 110 are defined in two insides defining the slot 11.

Two end collars 60 each have a flange 61 extending inward from an end thereof, and two holes 63 are defined through the flange 61. End collars 60 are respectively mounted to the two tubes 10 which movably extend through two respective holes 62 of the two end collars 60. The connection ends 31 of the cables 30 extend through the holes 63 and are secured by being connected with nuts.

Figure 4:
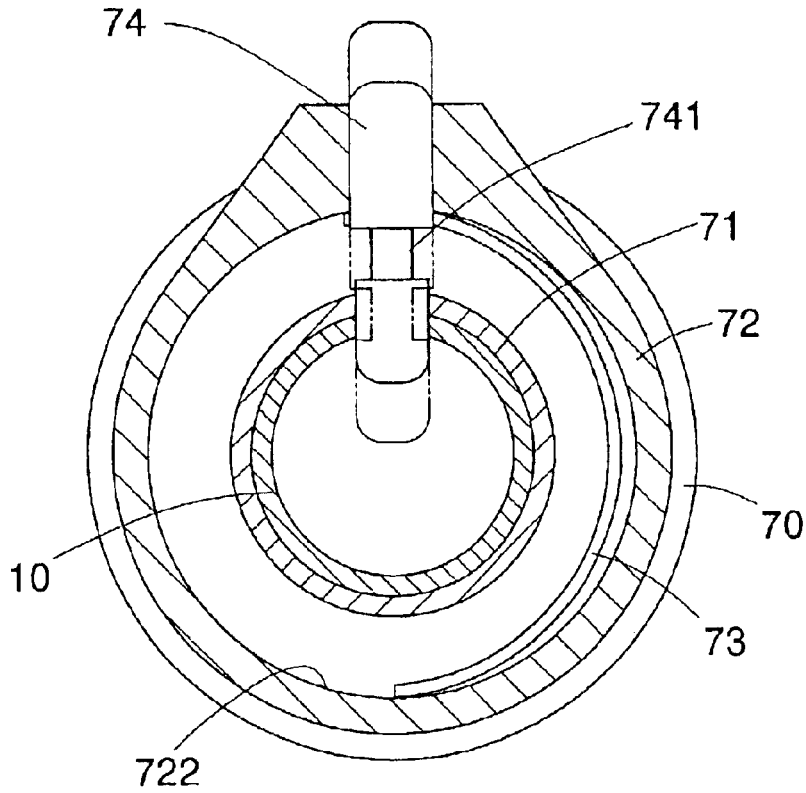
FIG. 4 is an end cross sectional view to show the positioning members pushed to allow the handles to be moved.

Further referring to FIG. 4, two handles 70 each have an extension 71, and a positioning hole 711 is defined through each of the extensions 71. Two mounting collars 72 are respectively mounted to the two extensions 71, and a through hole 721 is defined through each of the mounting collars 72. A positioning groove 722 is defined in each of the two mounting collars 72. Two positioning members 74 each have a spring member 73 which is a C-shaped spring wire and engaged with the positioning groove 722 so as to bias the positioning member 74 outward. Each of the positioning members 74 movably extends through the positioning hole 711 and is inserted in the slot 11. An annular groove 741 is defined in each of the positioning members 74 and a width of the annular groove 741 is larger than a thickness of the insides of the slot 11. The positioning members 74 are positioned in one of the positioning recesses 110 by the biasing force from the spring member 73, and one of two ends of the annular grooves 741 is biased against the surface of the positioning recesses 110 to position the handles 70.

When pushing the positioning members 74 downward, the handles 70 together with the tubes 10 can be pulled while the positioning members 74 are moved in the slots 11. The positioning members 74 are released to let one of the two ends of the annular grooves 741 bias against the surface of another of the positioning recesses 110 again to position the handles 70. Therefore, the distance between the handles 70 can be adjusted according to needs.

Figure 6:
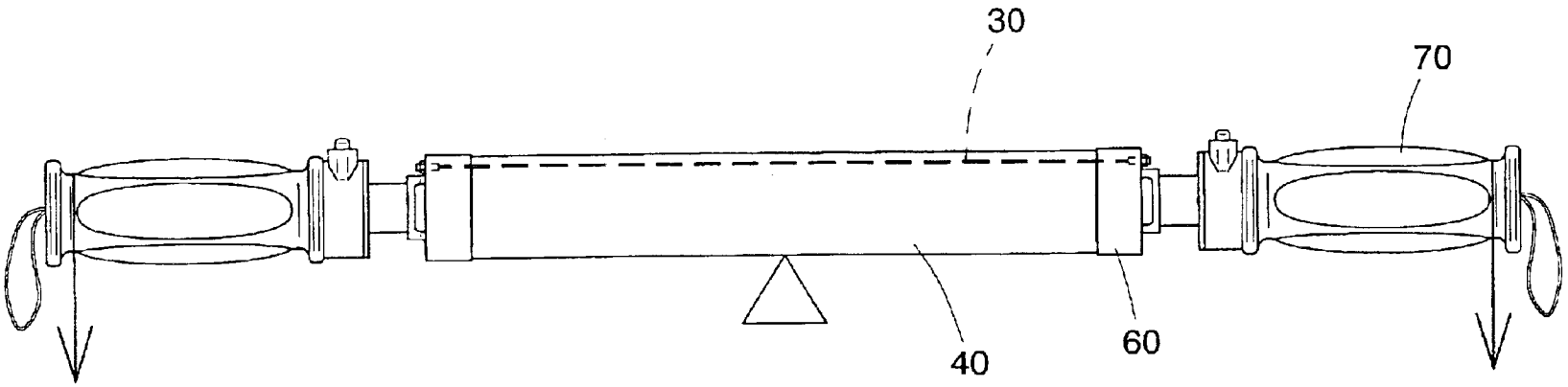
FIG. 6 shows the two cables on the spring bar cannot be bent.
Figure 7:
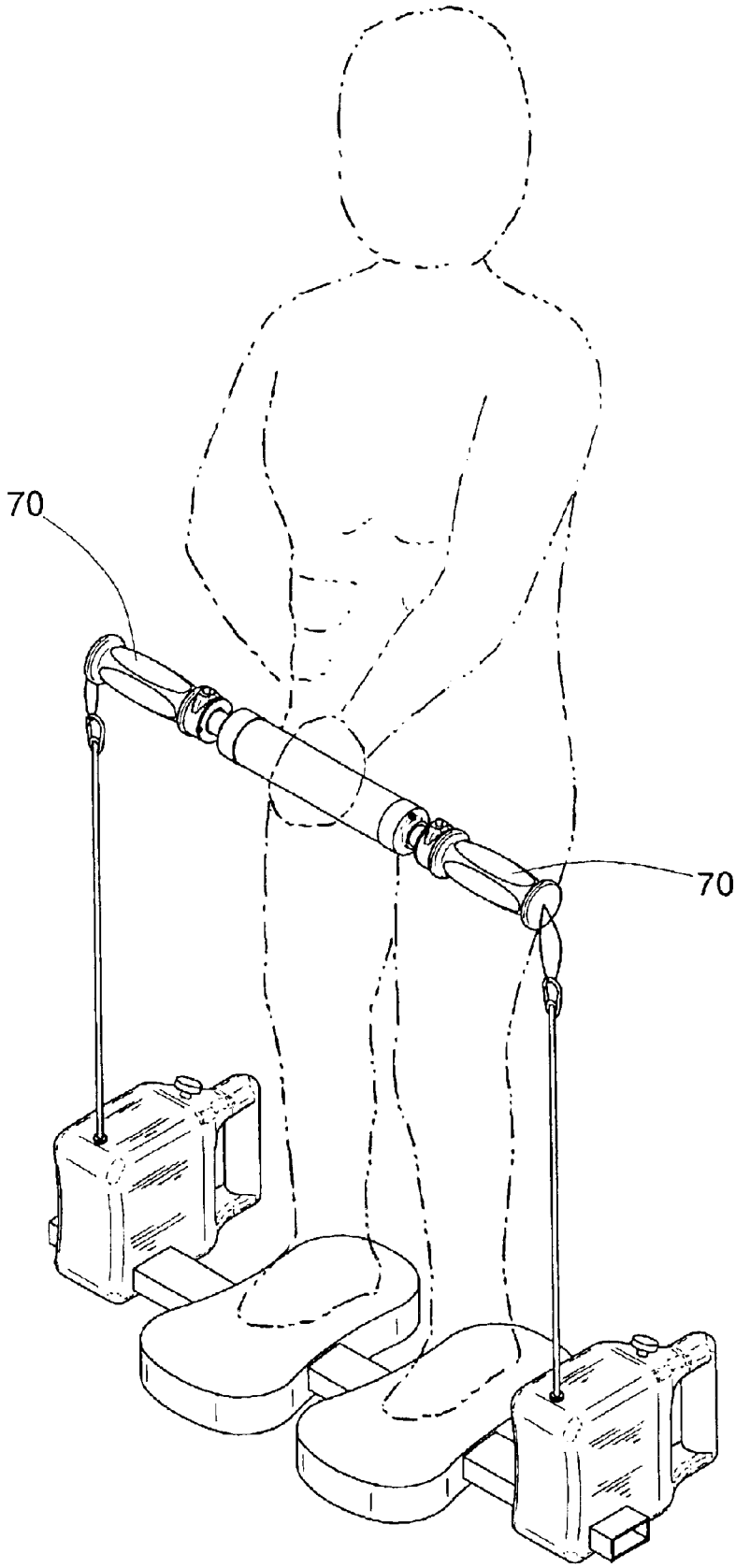
FIG. 7 shows the spring bar is cooperated with other exercising devices.
Figure 8:
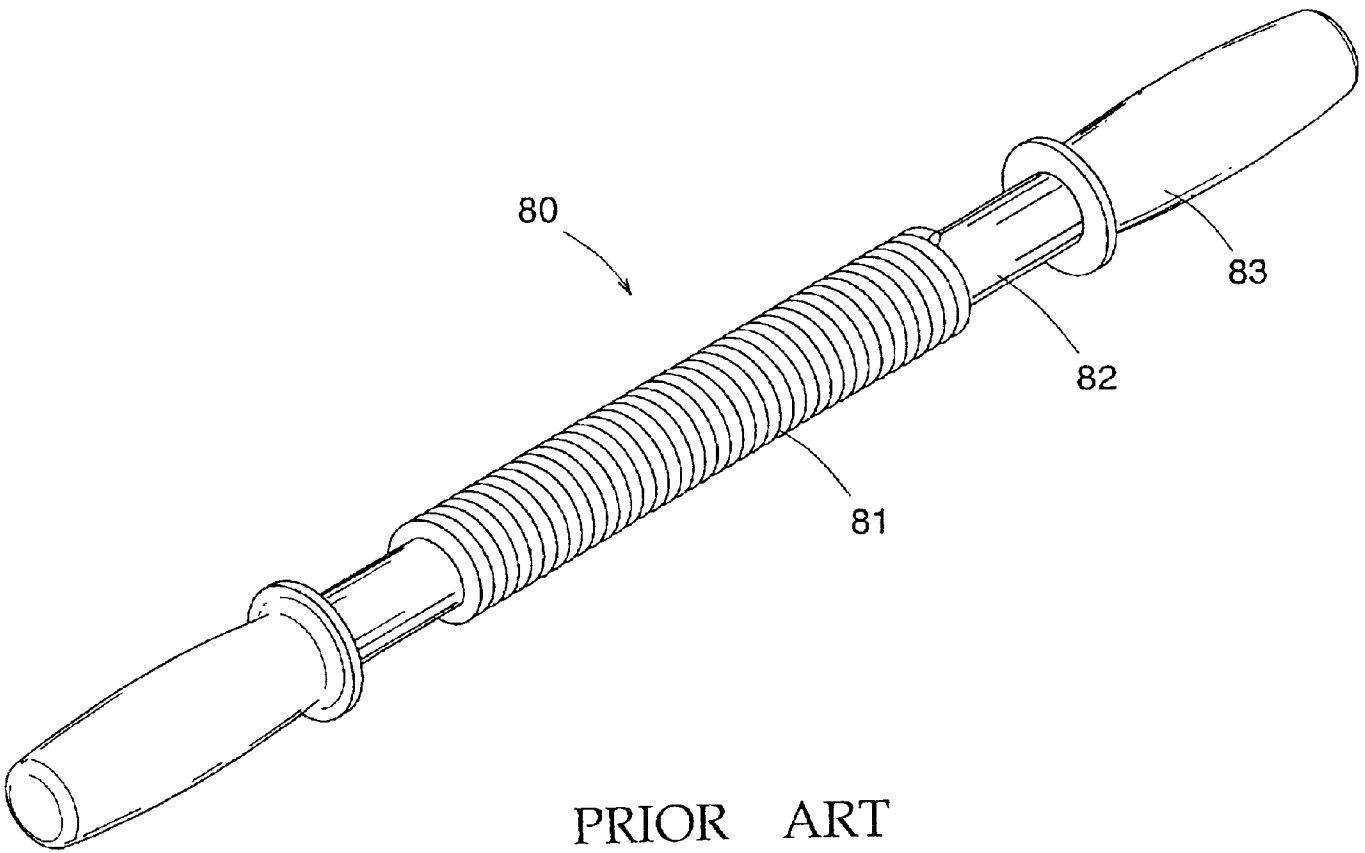
PRIOR ART FIG.8
FIG. 8 shows a conventional spring bar.

Referring to FIG. 6, if the two cables 30 are arranged at the top as shown and two forces are applied downward at the two handles 70, the cables 30 cannot be extended so that the spring bar cannot be bent at this arrangement. The spring bar can be bent if the cables 30 are arranged at the underside position. Referring to FIG. 7, the spring bar can be cooperated with other devices and the spring bar is used as a solid bar to lift weights hung on two handles 70.

While we have shown and described the embodiment in accordance with the present invention, it should be clear to those skilled in the art that further embodiments may be made without departing from the scope of the present invention.

What is claimed is:

1. A spring bar comprising:

a spring;

two cables 30 fixedly connected to an outside of the spring in a longitudinal direction of the spring and each cable having two connection ends at two ends thereof;

two tubes respectively connected to two ends of the spring and a slot 11 defined longitudinally through a wall of each of the tubes, a plurality of positioning recesses defined in two insides defining the slot;

two end collars respectively mounted to the two tubes which movably extend through two respective holes of the two end collars, the two connection ends 31 of each cable 30 being fixedly connected to the two end collars 60;

two handles 70 each having an extension 71 and a positioning hole 711 defined through each of the extensions 71, two mounting collars 72 respectively mounted to the two extensions 71 and a through hole 721 defined through each of the mounting collars 72; and two positioning members 74 each having a spring member 73 which is biased in the mounting collar 72 corresponding thereto, each of the positioning members 74 movably extending through the positioning hole 711 and inserted in the slot 11, an annular groove 741 defined in each of the positioning members 74 and a width of the annular groove 741 being larger than a thickness of the insides of the slot 11, the positioning members 74 being positioned in one of the positioning recesses 110.

2. The spring bar as claimed in claim 1, wherein the spring member is a C-shaped spring wire which is engaged with a positioning groove defined in each of the two positioning members.

3. The spring bar as claimed in claim 1, wherein the connection ends of the cables extend through holes defined through a flange extending inward from the end collars and are secured by being connected with nuts.

4. The spring bar as claimed in claim 1 wherein an angle between the two cables is 45 degrees relative to a center of the spring.

5. The spring bar as claimed in claim 1 further comprising a coat mounted on an outside of the spring.

* * * * *